United States Patent [19]

Matsumoto

[11] Patent Number: 4,762,348

[45] Date of Patent: Aug. 9, 1988

[54] ELECTRIC DOOR LOCK SYSTEM

[75] Inventor: Masaharu Matsumoto, Yokohama, Japan

[73] Assignee: Ohi Seisakusho Co., Ltd., Yokohama, Japan

[21] Appl. No.: 924,415

[22] Filed: Oct. 29, 1986

[30] Foreign Application Priority Data

Oct. 30, 1985 [JP] Japan ..... 60-241339

[51] Int. Cl.[4] ..... E05C 13/10

[52] U.S. Cl. ..... 292/201; 292/216; 292/DIG. 3; 292/DIG. 23; 70/279

[58] Field of Search ..... 292/201, 216, 280, 336.3, 292/DIG. 3, DIG. 23; 70/279

[56] References Cited

U.S. PATENT DOCUMENTS

| | | | |
|---|---|---|---|
| 4,126,341 | 11/1978 | Bradstock | 292/201 |
| 4,252,351 | 2/1981 | Yoshino et al. | 292/201 X |
| 4,502,718 | 3/1985 | Sasaki et al. | 292/201 X |
| 4,518,182 | 5/1985 | Cousin et al. | 292/201 |
| 4,554,808 | 11/1985 | Escaravage | 292/201 X |
| 4,588,217 | 5/1986 | Escaravage | 292/201 |

FOREIGN PATENT DOCUMENTS

| | | | |
|---|---|---|---|
| 2013574 | 2/1978 | Fed. Rep. of Germany | 292/201 |
| 1431579 | 4/1976 | United Kingdom | 292/201 |

*Primary Examiner*—Gary L. Smith
*Assistant Examiner*—Eric K. Nicholson
*Attorney, Agent, or Firm*—Foley & Lardner, Schwartz, Jeffery, Schwaab, Mack, Blumenthal & Evans

[57] ABSTRACT

An electric door lock system is disclosed which comprises an electric actuator which moves an output member in first and second directions selectively, a door locking mechanism which moves a latch plate of a door lock device proper from its half-latched position to its full-latched position when the output member is moved in the first direction, a lock cancelling mechanism which cancels the locked condition of the latch plate when the output member is moved in the second direction, a lock cancelling switch means incorporated with an inside or outside handle of the door, which operates in response to manipulation of the handle, a locking and unlocking switch means which operates when locking and unlocking of the door are required, a half-latched condition sensor which senses that the latch plate has come to the half-latched position from its open position, and a control means which functions so that when, with the door lock device proper being in its unlocked condition, the lock cancelling switch means is manipulated, the output member is moved in the second direction thereby to allow the latch plate to pivot toward its open position and when the half-latched condition sensor senses the reaching of the door to the half-latched position, the output member is moved in the first direction thereby to cause the latch plate from the half-latched position to the full-latched position.

15 Claims, 4 Drawing Sheets

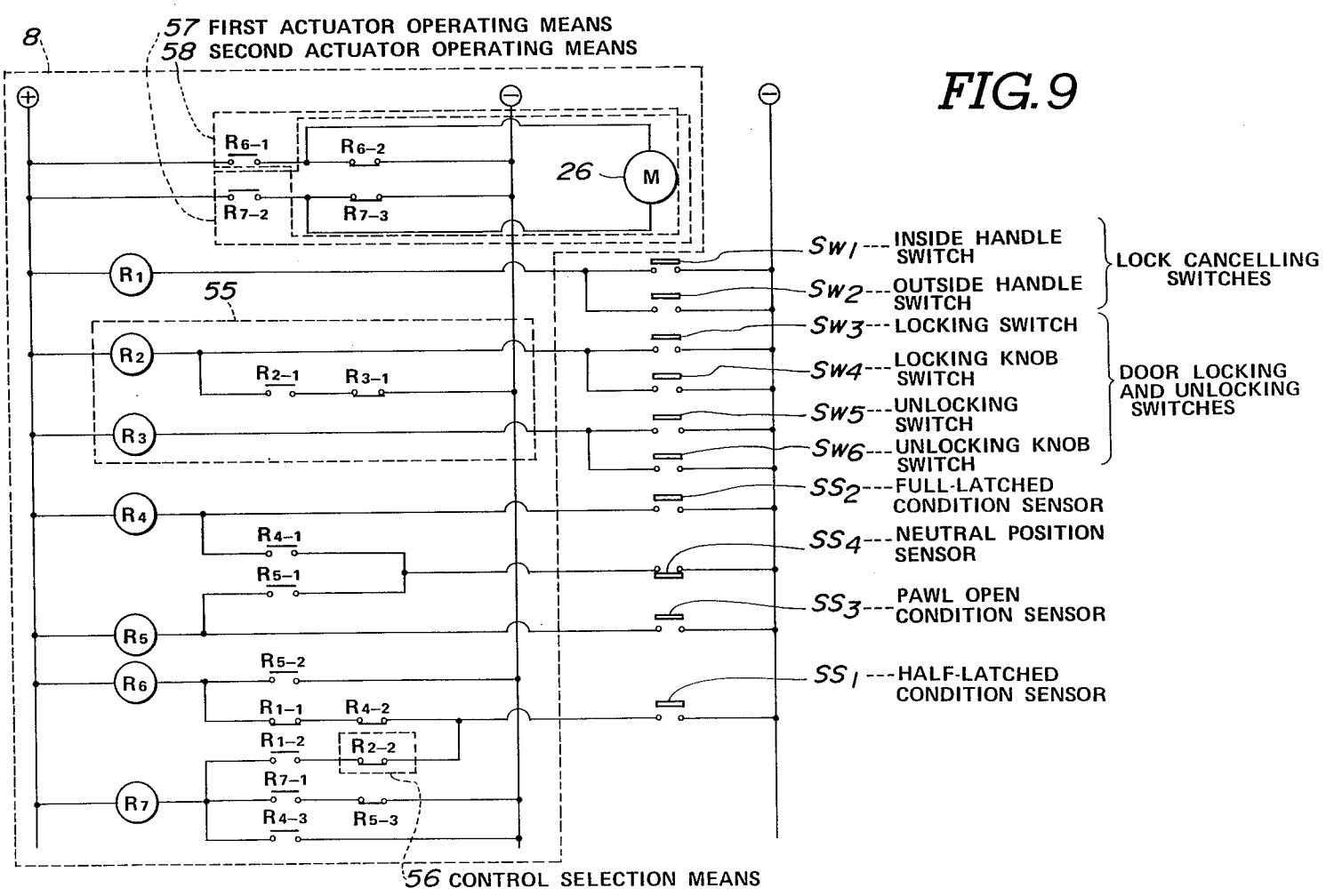
FIG. 9
LOCK CANCELLING SWITCHES
DOOR LOCKING AND UNLOCKING SWITCHES
SW1 INSIDE HANDLE SWITCH
SW2 OUTSIDE HANDLE SWITCH
SW3 LOCKING SWITCH
SW4 LOCKING KNOB SWITCH
SW5 UNLOCKING SWITCH
SW6 UNLOCKING KNOB SWITCH
SS2 FULL-LATCHED CONDITION SENSOR
SS4 NEUTRAL POSITION SENSOR
SS3 PAWL OPEN CONDITION SENSOR
SS1 HALF-LATCHED CONDITION SENSOR
57 FIRST ACTUATOR OPERATING MEANS
58 SECOND ACTUATOR OPERATING MEANS
56 CONTROL SELECTION MEANS
M
26
55
8
R1
R2
R3
R4
R5
R6
R7
R6-1
R6-2
R7-2
R7-3
R2-1
R3-1
R4-1
R5-1
R5-2
R1-1
R1-2
R7-1
R4-3
R4-2
R2-2
R5-3

ELECTRIC DOOR LOCK SYSTEM

BACKGROUND OF THE INVENTION

1. Field of the Invention

The present invention relates in general to a door lock system for a motor vehicle, and more particularly to automotive door lock systems of a type which is electrically controlled.

2. Description of the Prior Art

Japanese Patent First Provisional Publication No. 60-148974 shows an electric door lock system in which, as a substitute for the conventional mechanical linkages through which the outside handle, inside handle, locking and unlocking knob and the like are linked to the door lock device proper, there are employed electric parts for electrically controlling operation of the door lock device proper. Because of nonuse of the bulky mechanical linkages, the electric door lock system can be constructed compactly in the door structure.

However, the electric door lock system as disclosed by the Publication does not take into consideration the considerable counterforce which is produced, when the door is pivoted from its half-latched position to its full-latched position, against a spring-biased latch plate of the lock device proper and a weather strip of the door. That is, closing and full latching of the door is accomplished by strongly pushing the door toward the door opening. However, this method of fully closing the door sometimes induces malfunction of the electric door lock system because of a considerable shock applied thereto.

SUMMARY OF THE INVENTION

It is therefore an object of the present invention to provide an improved electric door lock system which is free of the above-mentioned drawback.

According to the present invention, there is provided an electric door lock system which comprises a door lock device proper including a latch plate engageable with a striker and a pawl plate engageable with the latch plate to lock the same; an actuator for moving an output member in first and second directions, selectively; a door locking mechanism which moves the latch plate from its half-latched position to its full-latched position when the output member is moved in the first direction; a lock cancelling mechanism which cancels the locked engagement of the pawl plate with the latch plate when the output member is moved in the second direction; a lock cancelling switch means which operates when opening of the door is required; a locking and unlocking switch means which operates when locking and unlocking of the door are required; a half-latched position sensor which senses the reaching of the latch plate to the half-latched position from its open position; and a control means which includes a locked and unlocked condition memory means which memorizes either the locked condition of the door or the unlocked condition of the same, a control selection means which makes the lock cancelling switch means operative when the memory means memorizes the unlocked condition of the door and makes the lock cancelling switch means inoperative when the memory means memorizes the locked condition of the door, a first actuator means which moves the output member in the second direction when the control selection means makes the lock cancelling switch means operative and the lock cancelling switch means is manipulated, and a second actuator means which moves the output member in the first direction when the half-latched condition sensor senses the reaching of the door to the half-latched position.

BRIEF DESCRIPTION OF THE DRAWINGS

Other objects and advantages of the present invention will become apparent from the following description when taken in conjunction with the accompanying drawings, in which:

FIG. 9 is a diagrammatically illustrated control circuit employed for controlling the electric door lock system of the invention.

DETAILED DESCRIPTION OF THE INVENTION

In the following, an embodiment of the present invention will be described in detail with reference to the attached drawings.

Figure 1:
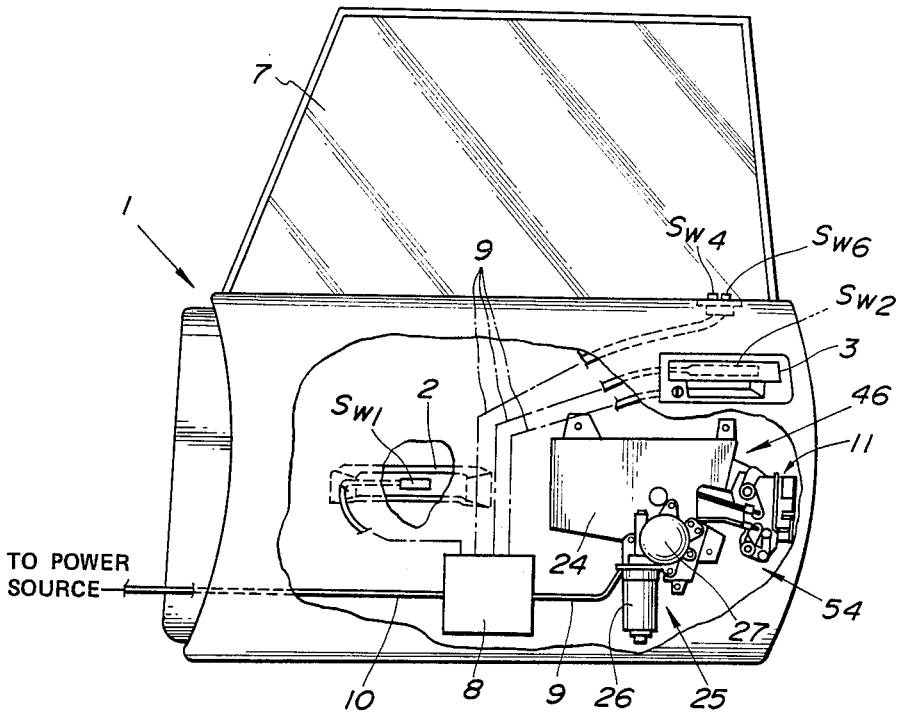
FIG. 1 is a partially broken front view of a vehicle door in which an electric door lock system of the present invention is installed.

Referring to FIG. 1, there is shown a layout of the electric door lock system of the invention, which is installed in a vehicle side door 1. The door 1 is hinged at its forward portion (viz., left portion in FIG. 1) to a body of the vehicle.

Designated by numeral 2 is an inside handle which is mounted to an inside portion of the door 1, and designated by numeral 3 is an outside handle which is mounted to an outside portion of the door 1. As will become apparent as the description proceeds, under unlocked condition of a door lock device proper, manipulation of either the inside handle 2 or the outside handle 3 brings the lock device proper into its open condition. An inside handle switch $Sw_1$ and an outside handle switch $Sw_2$ are installed behind the respective inside and outside handles 2 and 3, which close when the handles 2 and 3 are manipulated for the purpose of opening the door 1. As will be seen from the circuit of a control device of FIG. 9, the inside and outside handle switches $Sw_1$ and $Sw_2$ are of a so-called "lock cancelling switch means", which are actuated when cancelling of the locked condition of the door 1 is required.

Figure 2:
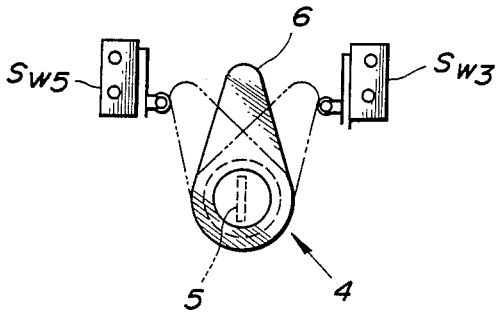
FIG. 2 is an enlarged view of a key-cylinder and its vicinity, which is taken from the inside of the associated door.

As is seen in FIG. 1, a key cylinder 4 is installed below the outside handle 3, which has a key hole 5 (see FIG. 2) exposed to the outside of the door 1. A push plate 6 is fixed to the key cylinder 4 to rotate therewith. Locking and unlocking switches $Sw_3$ and $Sw_5$ are arranged near the key cylinder 4 and assume their ON positions when the push plate 6 is turned into contact with them. That is, when a key (not shown) in the key hole 5 is turned clockwise in FIG. 2, the locking switch $Sw_3$ is turned ON, while, when the key is turned counterclockwise, the unlocking switch $Sw_5$ is turned ON. (It is to be noted that the illustration of FIG. 2 is taken from the inside of the door structure).

As is seen in FIG. 1, locking and unlocking knob switches $Sw_4$ and $Sw_6$ are arranged on a sill portion of the door 1 inboard of a window pane 7, which function like a commonly used locking-unlocking knob as will become apparent as the description proceeds.

Thus, it will be noted that the locking and unlocking switches $Sw_3$ and $Sw_5$ are operated when locking or unlocking of the door 1 is required from the outside of the vehicle, while, the locking and unlocking knob switches $Sw_4$ and $Sw_6$ are operated when locking or unlocking of the door 1 is required from the inside of the vehicle. The switches $Sw_3$ to $Sw_6$ are thus of a door locking and unlocking switch means, which are actuated when locking or unlocking of the door is required.

The switches $Sw_1$, $Sw_2$, $Sw_3$, $Sw_4$, $Sw_5$ and $Sw_6$ are connected through suitable wires 9 to the control device 8 which is arranged in a lower portion of the door 1. The control device 8 is connected to an electric power source, such as a car battery, through wires 10.

As is seen from FIG. 1, the door lock device proper 11 is installed in a rear (or right) portion of the door structure 1, which is constructed to latch and/or lock the door 1 relative to the vehicle body when the door 1 is swung to its closed position.

Figure 6:
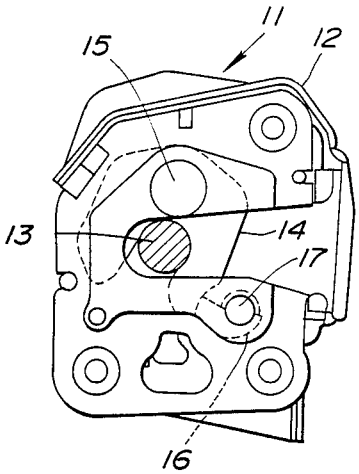
FIG. 6 is a view taken from the direction of the line VI—VI of FIG. 3, but showing a full-latched condition of the door lock device proper.
Figure 7:
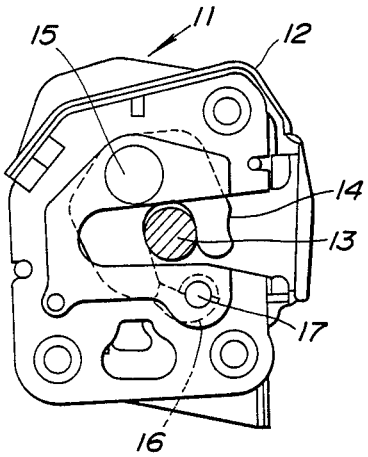
FIG. 7 is a view similar to FIG. 6, but showing a half-latched condition of the door lock device proper.
Figure 8:
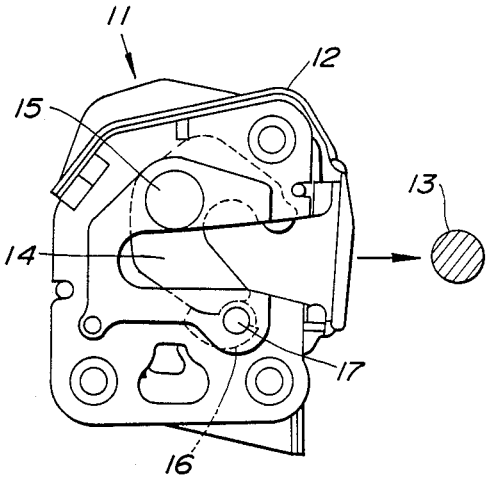
FIG. 8 is a view similar to FIG. 6, but showing an open condition of the door lock device proper.

As is shown in FIGS. 6 to 8, the door lock device proper 11 comprises a housing 12 in which a forked latch plate 14 is pivotally arranged through a pivot shaft 15. The pivot shaft 15 extends substantially parallel with a lateral axis of the door 1.

The latch plate 14 can assume an open position as shown in FIG. 8 wherein the same releases a striker 13 mounted to the vehicle body, a full-latched position as shown in FIG. 6 wherein the same completely latches the striker 13 thereby to keep the door 1 closed, and a half-latched position as shown in FIG. 7 wherein the same temporarily latches the striker 13. Although not shown in the drawings, a return spring is incorporated with the latch plate 14 to bias the same in a counterclockwise direction in FIGS. 6 to 8, that is, in the direction toward the open position of the latch plate 14.

A semi-circular pawl plate 16 is pivotally arranged in the housing 12 through a pivot shaft 17 which extends parallel with the afore-mentioned pivot shaft 15. When the latch plate 14 comes to either the full-latched position (FIG. 6) or the half-latched position (FIG. 7), the pawl plate 16 is brought into contact with a given portion of the latch plate 14 to suppress rotation of the same toward the open position. A spring 18 (see FIG. 5) is incorporated with the pawl plate 16 to bias the same in a clockwise direction in FIGS. 6 to 8. Thus, when, with the latch plate 14 assuming its full-latched or half-latched position, the pawl plate 16 is rotated counterclockwise in FIGS. 6 and 7 against the biasing force applied to the same, the latch plate 14 is permitted to pivot in the counterclockwise direction toward the open position thereof. Upon this, the striker 13 is released from the latch plate 14 thereby permitting the door 1 to open freely.

Respective ends of the pivot shafts 15 and 17 are projected outwardly from the housing 12. A pivot plate 19 is fixed to the projected end of the pivot shaft 15, and an open lever 20 is fixed to the projected end of the pivot shaft 17. Thus, the pivot plate 19 moves or rotates together with the latch plate 14, while, the open lever 20 moves or rotates together with the pawl plate 16.

Figure 5:
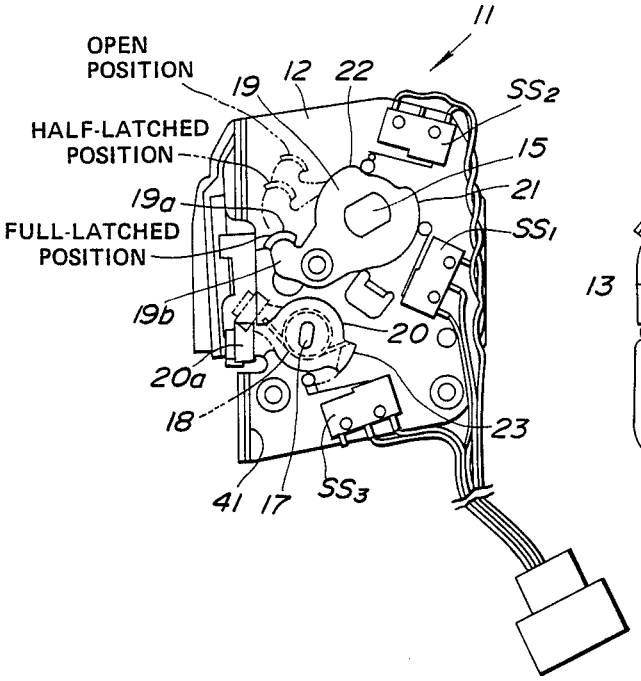
FIG. 5 is a sectional view taken along the line V—V of FIG. 3.

As is seen from FIG. 5, the pivot plate 19 is formed with an arm portion **19*b* the leading end portion of which is bent to form a contact portion 19*a*. The pivot plate 19 is formed at portions other than the arm portion 19*b* with first and second cam portions 21 and 22. A half-latched condition sensor or switch $SS_1$ is connected to the housing 12 and incorporated with the first cam portion 21 in such a manner that when the latch plate 14 assumes a position between the half-latched position and a just-before position of the half-latched position, the sensor $SS_1$ assumes its ON position. A full-latched condition sensor or switch $SS_2$ is also connected to the housing 12 and incorporated with the second cam portion 22 in such a manner that when the latch plate 14** assumes the full-latched position, the sensor $SS_2$ assumes its ON position.

The open lever 20 is formed with an arm portion **20*a* and a cam portion 23. A pawl open condition sensor or switch $SS_3$ is connected to the housing 12 and incorporated with the cam portion 23 in such a manner that when the pawl plate 16 comes to a position to release the latch plate 14**, the sensor $SS_3$ assumes its ON position.

As is understood from FIG. 1, a supporting plate 24 is arranged in the door structure 1 at a position forward of the door lock device proper 11. An electric actuator 25 is mounted to the supporting plate 24.

Figure 3:
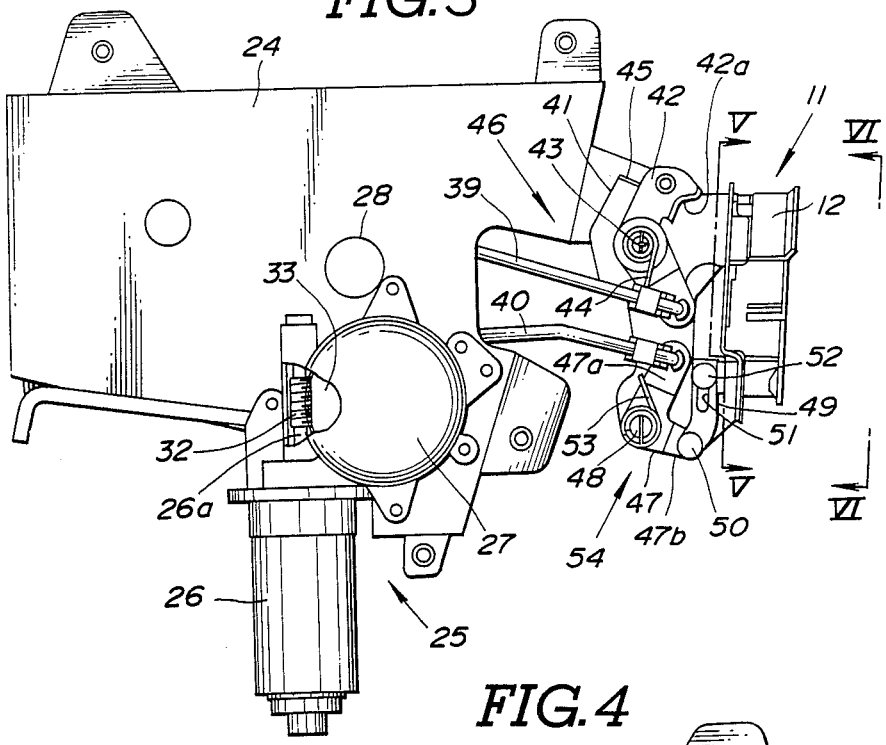
FIG. 3 is an enlarged front view of an essential part of the electric door lock system, which is taken from the outside of the door.
Figure 4:
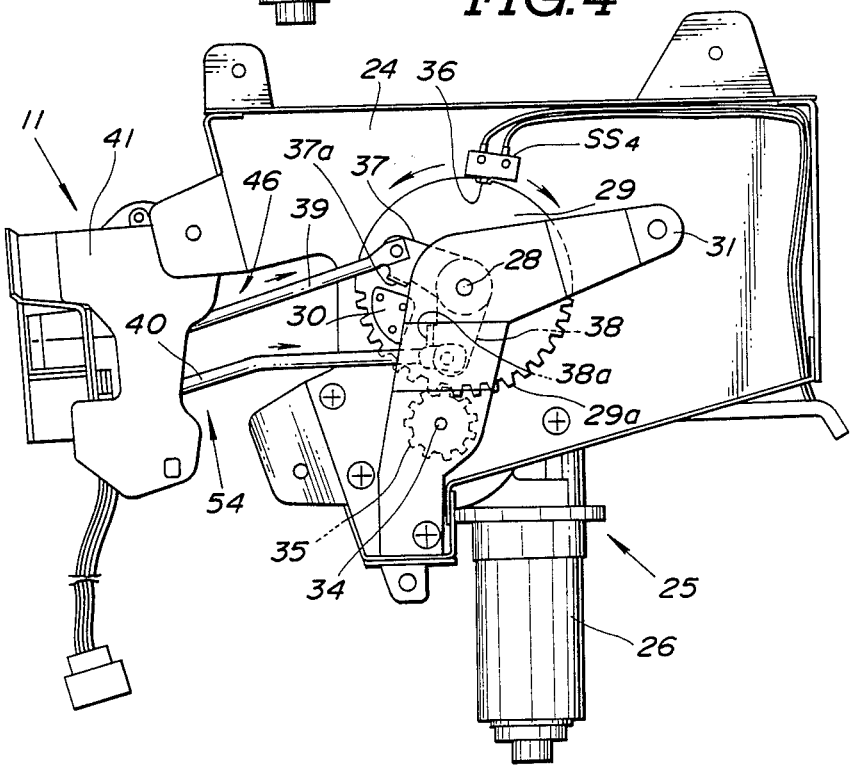
FIG. 4 is an enlarged back view of said the essential part, which is taken from the inside of the door.

As will be understood from FIGS. 3 and 4, the actuator 25 is arranged at a lower portion of the supporting plate 24 and comprises generally a reversible electric motor 26 connected through a wire 9 to the control device 8, a speed reduction gear 27 connected to the motor 26, an operation disc plate 29 pivotally connected through a pivot shaft 28 to the supporting plate 24 and driven by the gear 27, and a sectoral member 30 secured to the operation disc plate 29 to move therewith.

As is seen in FIG. 4, a wing-shaped plate 31 is fixed at its both ends to the supporting plate 24, which has a middle portion bearing one end of the pivot shaft 28.

The speed reduction gear 27 comprises a worm 32 (see FIG. 3) secured to a rotation shaft **26*a* of the electric motor 26, a worm wheel 33 meshed with the worm 32, and a pinion 35 (see FIG. 4) fixed to a rotation shaft 34 of the worm wheel 33. The pinion 35 is meshed with teeth 29*a* formed on the periphery of the operation disc plate 29. Thus, upon energization of the motor 26, the operation disc plate 29 is rotated through the worm 32, the worm wheel 33 and the pinion 35 in a clockwise or counterclockwise direction from its neutral position as shown in FIG. 4**.

The operation disc plate 29 is further formed at its periphery with a recess 36. A neutral position sensor or switch $SS_4$ is arranged in such a manner that a detecting pin (no numeral) thereof falls into the recess 36 of the disc plate 29 causing ON (or closed) condition of the sensor $SS_4$ when the disc plate 29 assumes its neutral position.

Between the wing-shaped plate 31 and the operation disc plate 29, there are arranged two (or first and second) arm members 37 and 38 which are pivotally disposed about the pivot shaft 28. Two (or first and second) rods 39 and 40 are pivotally connected to free ends of the arm members 37 and 38, respectively.

When, due to energization of the motor 26, the operation disc plate 29 is rotated in a clockwise direction from the neutral position in FIG. 4, the sectoral member 30 is brought into contact with a contact portion 37*a* of the arm member 37 thereby rotating the arm member 37 in the same direction and thus moving or pulling the rod 39 rightward in FIG. 4 as shown by an arrow. While, when the operation disc plate 29 is rotated in a counterclockwise direction from the neutral position in FIG. 4, the sectoral member 30 is brought into contact with a contact portion 38*a* of the other arm member 38 thereby rotating the arm member 38 in the same direction and thus moving or pulling the other rod 40 rightward as shown by an arrow.

As is best seen in FIG. 4, another supporting plate 41 is fixed to the housing 12 of the afore-mentioned door lock device proper 11. As is understood from FIG. 3, a bellcrank-like lever 42 is pivotally connected to an upper portion of the supporting plate 41 through a pivot shaft 43. The leading end of the rod 39 is pivotally connected to the lower arm section of the lever 42, so that when the rod 39 is pulled by the arm member 37 as described hereinabove, the lever 42 is pivoted in a clockwise direction thereby bringing a contact portion 42*a* of the upper arm section of the lever 42 into contact with the afore-mentioned contact portion 19*a* of the pivot plate 19. With this action, the pivot plate 19 and thus the latch plate 14 (see FIGS. 5, 6 and 7) is forced to pivot from the half-latched position (as shown in FIG. 7) to the full-latched position (as shown in FIG. 6).

Referring back to FIG. 3, a coil spring 44 is incorporated with the bellcrank-like lever 42 in order to bias the same in a counterclockwise direction in FIG. 3, that is, in the direction to move the contact portion 42*a* of the lever 42 away from the contact portion 19*a* of the pivot plate 19. Designated by numeral 45 in FIG. 3 is a stopper for stopping extreme counterclockwise rotation of the lever 42, which is formed by bending an upper portion of the supporting plate 41.

Thus, the arm member 37, the rod 39 and the lever 42 constitute a so-called "door locking mechanism" 46 which connects the sectoral member 30 of the electric actuator 25 with the latch plate 14 of the door lock device proper 11 in such a manner that the latch plate 14 is forced to pivot toward its full-latched position when the sectoral member 30 is moved in a clockwise direction in FIG. 4.

Referring back to FIG. 3, a L-shaped lever 47 is pivotally connected through a pivot shaft 48 to a lower portion of the supporting plate 41, which comprises two arm sections 47*a* and 47*b*. The leading end of the rod 40 is pivotally connected to the upper arm section 47*a* of the lever 47. Pivotally connected through a pivot shaft 50 to the lower arm section 47*b* of the lever 47 is a pressing bar 49 which extends vertically in FIG. 3. The pressing bar 49 is formed with a longitudinally extending slot 51 through which a headed pin 52 extending from the supporting plate 41 passes. Thus, upon pivoting movement of the L-shaped lever 47, the pressing bar 49 moves upward or downward having the slot 51 guided by the pin 52. Thus, when the rod 40 is pulled by the arm member 38 as described hereinabove, the L-shaped lever 47 is pivoted in a counterlockwise direction in FIG. 3 thereby moving the pressing bar 49 upward. This upward movement of the pressing bar 49 brings its upper portion into contact with an arm portion 20*a* of the afore-mentioned open lever 20 thereby pivoting the open lever 20 and thus the pawl plate 16 toward the latch plate releasing position. A spring 53 (see FIG. 3) is incorporated with the L-shaped lever 47 to bias the same in a clockwise direction, that is, in a direction to pull down the pressing bar 49.

Thus, the arm member 38, the rod 40, the L-shaped lever 47 and the pressing bar 49 constitute a so-called "lock cancelling mechanism" 54 which connects the sectoral member 30 of the electric actuator 25 with the pawl plate 16 of the door lock device proper 11 in such a manner that the pawl plate 16 is forced to pivot toward the latch plate releasing position when the sectoral member 30 is moved in a counterclockwise direction in FIG. 4.

Referring to FIG. 9, there is shown an electric circuit 8 which controls the electric door lock system of the invention.

The afore-mentioned inside handle switch $Sw_1$, outside handle switch $Sw_2$, locking switch $Sw_3$, locking knob switch $Sw_4$, unlocking switch $Sw_5$, unlocking knob switch $Sw_6$, full-latched condition sensor $SS_2$, neutral position sensor $SS_4$, a pawl open condition sensor $SS_3$ and half-latched condition sensor $SS_1$ are arranged in a manner as shown in the drawing. Furthermore, seven relay units $R_1$, $R_2$, $R_3$, $R_4$, $R_5$, $R_6$ and $R_7$ are arranged in the circuit as shown. Each relay switch is constructed to change its condition in response to ON-OFF operation of its associated switch or sensor. As shown, the first relay unit $R_1$ comprises a normally closed switch $R_{1-1}$ and a normally open switch $R_{1-2}$. Thus, when the inside handle switch $Sw_1$ is closed, the switch $R_{1-1}$ is open and the other switch $R_{1-2}$ is closed. The second relay unit $R_2$ comprises a normally open switch $R_{2-1}$ and a normally closed switch $R_{2-2}$. The third relay unit $R_3$ comprises a single normally closed switch $R_{3-1}$. The fourth relay unit $R_4$ comprises a normally open switch $R_{4-1}$, a normally closed switch $R_{4-2}$ and another normally open switch $R_{4-3}$. The fifth relay unit $R_5$ comprises a normally open switch $R_{5-1}$, another normally open switch $R_{5-2}$ and a normally closed switch $R_{5-3}$. The sixth relay unit $R_6$ comprises a normally open switch $R_{6-1}$ and a normally closed switch $R_{6-2}$, and the seventh relay unit $R_7$ comprises a normally open switch $R_{7-1}$, another normally open switch $R_{7-2}$ and a normally closed switch $R_{7-3}$. These normally open and closed switches change their conditions in response to energization or deenergization of the relay units, similar to the case of the above-mentioned first relay unit $R_1$.

It is to be noted that the second relay unit $R_2$, the third relay unit $R_3$, the normally open switch $R_{2-1}$ and the normally closed switch $R_{3-1}$ constitute a so-called "locking and unlocking condition memory means" 55 which can memory either locking or unlocking condition of the door lock device proper 11 by the operations of the switches $Sw_3$ to $Sw_6$. That is, when either the locking switch $Sw_3$ or the locking knob switch $Sw_4$ is closed, the second relay unit $R_2$ is energized thereby closing the normally open switch $R_{2-1}$ thereof. When, thereafter, either the unlocking switch $Sw_5$ or the unlocking knob switch $Sw_6$ is closed, the third relay unit $R_3$ is energized thereby opening the normally closed switch $R_{3-1}$ thereof and thus deenergizing the second relay unit $R_2$.

Thus, when the second relay unit $R_2$ is kept energized, the memory means 55 memorizes that the door lock device proper 11 is in its locked condition, while, when the second relay unit $R_2$ is kept deenergized, the memory means 55 memorizes that the door lock device proper 11 is in its unlocked condition.

The normally closed switch $R_{2-2}$ of the second relay unit $R_2$ constitutes a so-called "control selection means" 56 which makes the inside and outside handle switches $Sw_1$ and $Sw_2$ operative when the unlocked condition of the door lock device proper 11 is kept memorized by the memory means 55, and makes the switches $Sw_1$ and $Sw_2$ inoperative when the locked condition of the lock device proper 11 is kept memorized by the memory means 55. That is, when, due to the unlocked condition of the lock device proper 11, the second relay unit $R_2$ is deenergized, the normally closed switch $R_{2-2}$ is closed. Thus, under this condition, when either the inside handle switch $Sw_1$ or the outside handle switch $Sw_2$ is closed, the first relay unit $R_1$ is energized thereby closing the normally open switch $R_{1-2}$ thereof. As will become apparent hereinafter, the closing of the switch $R_{1-2}$ energizes the seventh relay unit $R_7$ and thus energizes the motor 26 to run in a direction to pivot the pawl plate 16 of the lock device proper 11 in a direction to release the latch plate 14. (It is to be noted that when the door 1 is closed, the half-latched condition sensor or switch $SS_1$ is closed.) While, when, due to the locked condition of the lock device proper 11, the second relay unit $R_2$ is energized, the normally closed switch $R_{2-2}$ is opened. Under this condition, the seventh relay unit $R_7$ can not be energized even when the inside and outside handle switches $Sw_1$ and $Sw_2$ are manipulated for closing the normally open switch $R_{1-2}$ of the first relay unit $R_1$.

The seventh relay unit $R_7$, the normally open switch $R_{7-2}$ and the normally closed switch $R_{7-3}$ of the relay unit $R_7$ and the normally closed switch $R_{6-2}$ of the sixth relay unit $R_6$ constitute a so-called "first actuator operating means" 57 which functions so that when, with the normally closed switch $R_{2-2}$ of the second relay unit $R_2$ being closed, the inside and outside handle switches $Sw_1$ and $Sw_2$ are operated, the afore-mentioned sectoral member 30 is forced to rotate in a counterclockwise direction in FIG. 4.

That is, when the seventh relay unit $R_7$ is energized, a circuit including an electric power source, the normally open switch $R_{7-2}$, the motor 26 and, the normally closed switch $R_{6-2}$ is established and thus, the motor 26 is energized to run in a given direction, that is, in a direction to rotate the sectoral member 30 in a counterclockwise direction in FIG. 4.

The sixth relay unit $R_6$, the normally open switch $R_{6-1}$ and the normally closed switch $R_{6-2}$ of the relay unit $R_6$ and the normally closed switch $R_{7-3}$ of the seventh relay unit $R_7$ constitute a so-called "second actuator operating means" 58 which functions so that when the half-latched condition sensor $SS_1$ is operated, the sectoral member 30 is forced to rotate in a clockwise direction in FIG. 4.

That is, when the sixth relay unit $R_6$ is energized due to closing of the half-latched condition sensor $SS_1$, a circuit including the electric power source, the normally open switch $R_{6-1}$, the motor 26 and the normally closed switch $R_{7-3}$ is established and thus, the motor 26 is energized to run in a reversed direction, that is, in a direction to rotate the sectoral member 30 in a clockwise direction in FIG. 4.

Although not shown in the circuit of FIG. 9, a known means is included which functions to return the sectoral member 30 of the electric actuator 25 to its neutral position (see FIG. 4) upon establishment of the above-mentioned counterclockwise or clockwise rotation of the sectoral member 30.

In the following, operation of the electric door lock system will be entirely described with reference to the control circuit of FIG. 9.

When, as has been mentioned hereinabove, the locked condition of the lock device proper 11 is kept memorized by the memory means 55, the manipulation of the inside and outside handle switches $Sw_1$ and $Sw_2$ is inoperative thereby keeping the door locked. That is, under this condition, the door can not be opened even when the inside and outside handles 2 and 3 are manipulated.

When, however, the unlocking knob switch $Sw_6$ is manipulated from the inside of the vehicle, or the unlocking switch $Sw_5$ is manipulated by a key in the key cylinder 4 from the outside of the vehicle, requirement of unlocked condition of the lock device proper 11 is newly memorized by the memory means 55 and thus the second relay unit $R_2$ is deenergized thereby closing the normally closed switch $R_{2-2}$ of the second relay unit $R_2$.

When, under this condition, the inside or outside handle 2 or 3 is manipulated for closing the corresponding switch $Sw_1$ or $Sw_2$, the first relay unit $R_1$ is energized thereby to close the normally open switch $R_{1-2}$ and thus the seventh relay unit $R_7$ is energized thereby to close the normally open switch $R_{7-2}$. Thus, in this condition, the first actuator operating means 57 energizes the motor 26 to run in a direction to rotate the sectoral member 30 in a counterclockwise direction in FIG. 4. Thus, the rod 40 is pulled rightward in FIG. 4 thereby pivoting the pawl plate 16 into the latch plate releasing position. Upon this, the latch plate 14 is forced to pivot to its open position (see FIG. 8) due to the work of the associated return spring, releasing the striker 13. With this, the door 1 is opened slightly. Thus, thereafter, the door 1 can be opened by pulling the same outwardly. Due to opening of the door 1, the half-latched condition sensor $SS_1$ is opened and the pawl open condition sensor $SS_3$ is closed. Due to closing of the pawl open condition sensor $SS_3$, the fifth relay unit $R_5$ is energized thereby closing the normally open switch $R_{5-1}$. Because, under this condition, the disc plate 29, viz., the sectoral member 30 is in a position away from its neutral position, the neutral position sensor $SS_4$ is kept closed. Due to energization of the fifth relay unit $R_5$, the normally closed switch $R_{5-3}$ is opened thereby deenergizing the seventh relay unit R , and thus energization of the motor 26 stops. At the same time, the normally open switch $R_{5-2}$ is closed and thus the sixth relay unit R is energized thereby closing the normally open switch $R_{6-1}$. Thus, the second actuator operating means 58 energizes the motor 26 to run in a direction to rotate the sectoral member 30 in a clockwise direction in FIG. 4. When the disc plate 29 viz., the sectoral member 30 comes to its neutral position, the neutral position sensor $SS_4$ is opened thereby deenergizing the fifth relay unit $R_5$. Thus, the normally open switch $R_{5-2}$ is opened thereby deenergizing the sixth relay unit $R_6$, and thus energization of the motor 26 stops.

It is to be noted that when the door 1 is kept opened, the sensors $SS_1$, $SS_2$, $SS_3$ and $SS_4$ are all opened.

When, thereafter, the door 1 is pivoted from its open position to its half-latched position, the half-latched condition sensor $SS_1$ is closed thereby energizing the sixth relay unit $R_6$ and thus closing the normally open switch $R_{6-1}$. Thus, the second actuator operating means 58 energizes the motor 26 to run in a direction to rotate the sectoral member 30 in a clockwise direction in FIG. 4. With this, the rod 39 is pulled rightward in FIG. 4.

Thus, as has been described hereinabove, the door locking mechanism 46 forces the latch plate 14 of the door lock device proper 11 to pivot into its full-latched position. When the latch plate 14 is brought into the full-latched position, the full-latched condition sensor $SS_2$ is closed thereby energizing the fourth relay unit $R_4$ and thus closing the normally open switch $R_{4\text{-}1}$. Because, under this condition, the disc plate 29 and thus the sectoral member 30 is in a position away from the neutral position, the neutral position sensor $SS_4$ is closed. Due to energization of the fourth relay unit $R_4$, the normally closed switch $R_{4\text{-}2}$ is opened thereby deenergizing the sixth relay unit $R_6$ and thus opening the normally open switch $R_{6\text{-}1}$. Thus, energization of the motor 26 stops.

At the same time, the normally open switch $R_{4\text{-}3}$ is closed thereby energizing the seventh relay unit $R_7$ and thus closing the normally open switch $R_{7\text{-}2}$. Thus, the first actuator operating means 57 energizes the motor 26 to run in a direction to rotate the sectoral member 30 in a counterclockwise direction. When the sectoral member 30, viz., the disc plate 29 is returned to its neutral position, the neutral position sensor $SS_4$ is opened thereby deenergizing the fourth relay unit $R_4$ and thus opening the normally open switch $R_{4\text{-}3}$. Thus, the seventh relay unit $R_7$ is deenergized and thus the normally open switch $R_{7\text{-}2}$ is opened. Thus, energization of the motor 26 stops.

As is understood from the foregoing description, in accordance with the present invention, only one electric actuator is employed for not only bringing the door from its half-latched condition into its full-latched condition, but also cancelling the locked condition of the door.

What is claimed is:

1. An electric door lock system comprising:

a door lock device including a latch plate movable between a half-latched position, a full-latched position, and an open position and engageable with a striker and a pawl plate engageable with said latch plate to lock the same;

an output member means which is movable in first and second directions;

an actuator means having a first actuation means and a second actuation means for moving the output member means in said first and second directions, selectively;

a door locking mechanism means which moves said latch plate from said half-latched position to said full-latched position when said output member is moved in said first direction;

a lock releasing mechanism means which cancels the locked engagement of said pawl plate with said latch plate when said output member means is moved in said second direction;

a lock releasing switch means which actuates the lock releasing mechanism means and operates when opening of the door is required;

a locking and unlocking switch means which actuates the door locking mechanism means and operates when locking and unlocking of the door are required;

a half-latched condition sensor means which senses the reaching of said latch plate to said half-latched position from said open position; and a control means for controlling the operation of said door lock system and includes a locked and unlocked condition memory means which memorizes either the locked condition of the door or the unlocked condition of the same, a control selection means which makes said lock releasing switch means operative when said memory means memorizes said unlocked condition of the door and makes said lock releasing switch means inoperative when said memory means memorizes said locked condition of the door, the first actuation means which moves said output member means in said second direction when said control selection means makes said lock releasing switch means operative and the lock releasing switch means is manipulated, and the second actuation means which moves said output member means in said first direction when the half-latched condition sensor senses reaching of the door to the half-latched position.

2. An electric door lock system as claimed in claim 1, in which said actuator means comprises:

a reversable electric motor electrically connected to said control means;

a speed reduction gear connected to said motor to be driven by the same;

an operation disc plate driven by said speed reduction gear; and a sectoral member secured to said operation disc plate to move therewith, said sectoral member acting as said output member means.

3. An electric door lock system as claimed in claim 2, in which said operation disc plate is formed at a periphery with teeth which are meshed with a pinion of said speed reduction gear.

4. An electric door lock system as claimed in claim 2, in which said door locking mechanism comprises:

a first arm pivotally arranged near said sectoral member and pushed by said sectoral member when the latter is moved in said first direction;

a first rod pivotally connected at one end to said first arm to move therewith;

a bellcrank like lever pivotally arranged and having two arm portions, one arm portion being pivotally connected to the other end of said first rod; and a pivot plate movable together with said latch plate and having a contact portion thereof with which the other arm portion of said bellcrank lever is brought into engagement when said first rod is moved in a given direction in response to the movement of said sectoral member in said first direction.

5. An electric door lock system as claimed in claim 4, in which said pivot plate is connected to said latch plate through a pivot shaft of said latch plate.

6. An electric door lock system as claimed in claim 5, in which the other arm portion of said bellcrank-like lever and said pivot plate are so arranged that when said sectoral member is moved in said first direction, said pivot plate is rotated to cause said latch plate to rotate in a direction from said half-latched position to said full-latched position.

7. An electric door lock system as claimed in claim 2, in which said lock releasing mechanism comprises:

a second arm pivotally arranged near said sectoral member and pushed by said sectoral member when the latter is moved in said second direction;

a second rod pivotally connected at one end to said second arm to move therewith;

a L-shaped lever pivotally arranged and having two arm portions, one arm portion being pivotally connected to the other end of said second rod;

a pressing bar pivotally connected to the other arm portion of said L-shaped lever to move therewith; and an open lever movable together with said pawl plate and having an arm portion thereof with which said pressing bar is brought into engagement when said second rod is moved in a given direction in response to the movement of said sectoral member in said second direction.

8. An electric door lock system as claimed in claim 7, in which said open lever is connected to said pawl plate through a pivot shaft of the pawl plate.

9. An electric door lock system as claimed in claim 8, in which said pressing bar and said open lever are so arranged that when said sectoral member is moved in said second direction, said open lever is rotated to cause said pawl plate to rotate in a direction to cancel the locked engagement of said pawl plate with said latch plate.

10. An electric door lock system as claimed in claim 1, in which said lock releasing switch means comprises switches which are incorporated with inside and outside open handles mounted to the door, said switches operating in response to manipulation of said handles.

11. An electric door lock system as claimed in claim 10, in which said locking and unlocking switch means comprises switches which are incorporated with a key cylinder installed in the door, said switches operating in response to manipulation of a key in said key cylinder.

12. An electric door lock system as claimed in claim 11, in which said locking and unlocking switch means further comprises switches which are incorporated with a locking knob installed on the door, said switches operating in response to manipulation of said locking knob.

13. An electric door lock system as claimed in claim 12, in which said half-latched condition sensor comprises a switch which operates in response to movement of said latch plate.

14. An electric door lock system as claimed in claim 13, further comprising:

a full-latched condition sensor means incorporated with said latch plate which applies a corresponding signal to said control means when said latch plate comes to its full-latched position;

a pawl open condition sensor means incorporated with said pawl plate which applies a corresponding signal to said control means when said pawl plate releases said latch plate; and a neutral position sensor means incorporated with said output member means of said actuator means which applies a corresponding signal to said control means when said output member means comes to a neutral position.

15. An electric door lock system as claimed in claim 14, in which said control means comprises a plurality of relay units each having at least one normally open switch and at least one normally closed switch.

* * * * *